United States Patent [19]

Shepherd

[11] 4,150,727

[45] Apr. 24, 1979

[54] DOWNCROWDING DEVICE FOR EARTH BORING MACHINES

[75] Inventor: William L. Shepherd, West University Place, Tex.

[73] Assignee: Hughes Tool Company, Houston, Tex.

[21] Appl. No.: 868,602

[22] Filed: Jan. 11, 1978

[51] Int. Cl.[2] ..... B23Q 5/00

[52] U.S. Cl. ..... 173/147; 173/81

[58] Field of Search ..... 173/147, 149, 151, 81, 173/85, 86, 87

[56] References Cited

U.S. PATENT DOCUMENTS

| | | | |
|---|---|---|---|
| 3,717,205 | 2/1973 | Wilderman | 173/147 |
| 3,719,238 | 3/1973 | Campbell et al. | 173/147 |
| 3,721,305 | 3/1973 | Mayer et al. | 173/147 |
| 3,987,856 | 10/1976 | Carl et al. | 173/149 |
| 3,994,350 | 11/1976 | Smith et al. | 173/147 |

*Primary Examiner*—Robert A. Hafer

*Attorney, Agent, or Firm*—Robert A. Felsman

[57] ABSTRACT

A device for applying an additional downward force to the rotating cutting tool of an earth boring machine. The machine has a mast and a rotating drive member suspended by the mast for vertical movement and for rotating the cutting tool. A rotatable drum is carried by hydraulic cylinders adjacent and below the top of the drive member. The drum has a brake and is connected by a downcrowding cable to the top of the drive member. Downward movement of the hydraulic cylinders while the drum brake is locked creates tension in the cable, applying downward force to the drive member. A take-up cable is wrapped around the drum in the opposite direction. It is reeved over the mast and connected to the top of the drive member by a spring. The spring takes up slack in the cable when the hydraulic cylinder returns for a new stroke and allows the kelly to move downward as the drum is pulled down by the cylinder.

9 Claims, 6 Drawing Figures

DOWNCROWDING DEVICE FOR EARTH BORING MACHINES

BACKGROUND OF THE INVENTION

1. Field of the Invention

This invention relates in general to earth boring machines and in particular to a device for applying a downcrowding force onto a rotating cutting tool.

2. Description of the Prior Art

Large diameter relatively shallow holes for foundation piers and the like are often drilled with an auger, either mounted on a truck or on a crane. If on a crane, a rotary table is carried on a platform held by the body and boom of the crane. A pipe known as a kelly is suspended from the boom and lowered through the rotary table. An auger is connected to the bottom of the kelly. The kelly may be square, hexagonal, or round with keys. The rotary table mates with the sides or keys of the kelly to rotate the auger for drilling.

Certain of these units rely on a friction crowd mechanism to apply force to the kelly in addition to kelly weight to advance the auger into the earth. The friction crowd mechanism comprises hydraulic cylinders for moving the rotary bushing downward. Because of the friction between the bushing and the kelly while under torque, the hydraulic cylinders apply a downwardly acting force on the kelly. This force, however, is limited to the friction contact, which may be inadequate for drilling very hard formations.

Certain truck mounted augers utilize a hydraulic cylinder for downcrowding. A sheave is mounted to the top of the kelly for movement therewith. A winch drum is fixedly mounted to the frame. It has two cables wound opposite to each other so that as one is wound in, the other plays out by an equal amount. A series of sheaves are arranged so as to raise or lower the kelly depending on the direction of rotation of the drum. A hydraulic cylinder is mounted in the derrick and through a fixed sheave arrangement will apply a downward force to the kelly sheave when the drum brake is set. While successful, this system requires a mast or derrick capable of withstanding the downcrowding force.

Other types of downcrowding devices are found in the patented art for earth boring machines generally. U.S. Pat. No. 3,717,205 discloses a draw works for an oil and gas well drilling rig. This rig includes a power driven winch drum that has two cables wrapped around it in opposite directions. One cable extends directly to the driving head that rotates the drill pipe, while the other is reeved over the boom and connected to the drilling head. Rotating the drum in one direction moves the drilling head downward, and rotating the drum in the opposite direction moves the drilling head upward. Any downcrowding force must be supplied through the power winch. This requires a large power input for a large downcrowding force, as well as slipping of the clutch to maintain a constant load.

SUMMARY OF THE INVENTION

It is a general object of this invention to provide an improved device for applying additional force on the rotating cutting tool of an earth boring machine.

It is a further object of this invention to provide an improved downcrowding device for an auger drilling machine that does not require a power driven winch, does not transmit the downcrowding force through the mast and does not rely on friction to transmit the downcrowding force.

It is a further object of this invention to provide an improved downcrowding device for an auger drilling machine that does not utilize a power driven winch and has automatic means for taking up slack in the downcrowding cable as the kelly is moved vertically with respect to the boom.

In accordance with these objects, a downcrowding device is provided that comprises a rotatable drum mounted near the rotary table on hydraulic rams so that it can be moved vertically. The drum has a selectively applied brake for preventing rotation and is connected to the top of the kelly head by a downcrowding cable. The hydraulic rams force the drum downward while the brake is locked to create tension in the cable and apply downward force on the kelly. A take-up cable is wrapped around the drum opposite to the downcrowding cable. It is reeved over the boom sheave and attached to the kelly by a spring. The spring stretches to allow the kelly and drum to move downward while the brake is locked. On each new stroke, as the drum is moved upward with the brake released, the spring forces the drum to rotate to take up slack in the downcrowding cable. In addition, the hydraulic circuit has sustaining means for maintaining pressure at the hydraulic rams as they move incrementally downward.

DESCRIPTION OF THE PREFERRED EMBODIMENT

Figure 1:
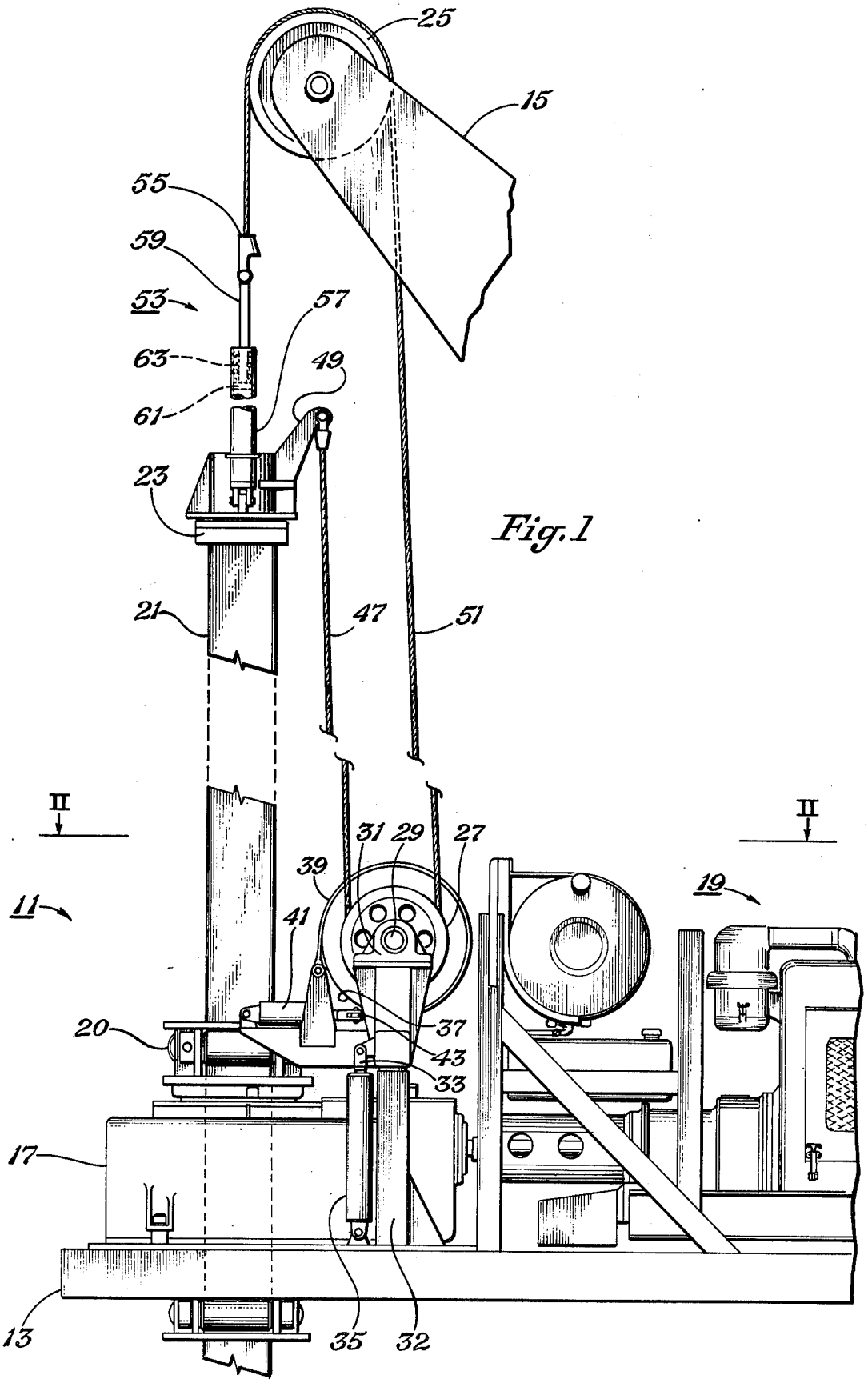
FIG. 1 is a side elevational view of a downcrowding device constructed in accordance with this invention.

Referring to FIG. 1, an auger drilling machine mounted to a crane is shown. The auger drilling machine 11 comprises a drilling platform 13 connected by a structure (not shown) to the base of the mast or boom 15 of the crane. A rotary table 17 and its power unit 19 are carried on platform 13. The rotary table 17 supports a kelly bushing 20 that is rotated by power unit 19.

A kelly 21 is adapted to extend slidingly into a square aperture 22 in kelly bushing 20. Kelly 21 comprises a length of pipe with four flat sides that mate with the sides of the kelly bushing 20 for rotation therewith. Kelly 21 includes a kelly head 23 at its top that swivels on kelly 21. A cable (not shown) from the crane winch (not shown) is reeved over a sheave (not shown) at the end of boom 15 and connected to kelly head 23 for hoisting kelly 21. Lateral guy wires (not shown) extend from the top of the boom 15 to the platform 13, passing through outriggers (not shown) on the kelly head 23 for preventing rotational movement of the kelly head 23 when kelly 21 is rotated. An auger (not shown) is connected to the bottom of kelly 21, or to intermediate joints of pipe at the bottom of kelly 21, to serve as a cutting tool for penetrating the earth. Consequently, the kelly 21 serves as a drive member, and the rotary table 17 and power unit 19 serve as the means for rotating it.

Downcrowding means for exerting a downward force on the kelly 21 includes a rotatable drum 27 carried by platform 13. The term "down" refers to the direction in which the hole is being drilled, although on some units and under certain circumstances the drilled hole may not be vertical. Drum 27 is mounted rotatably on an axle 29 and is not power driven. Axle 29 is carried in a frame 31 that is reciprocally carried by platform 13 through telescoping members 32 on each side of the frame. Frame 31 is also connected on each side to the piston shaft 33 of a hydraulic ram or cylinder 35. The two hydraulic cylinders 35 are mounted parallel with the kelly 21 and serve to move drum 27 in a line parallel with kelly 21. The telescoping members 32 add strength and stability.

A smooth cylindrical surface 37 on one side of drum 27 cooperates with a mating brake band 39 and a hydraulic cylinder 41 to serve as a braking means for selectively preventing rotation of drum 27. Hydraulic cylinder 41 is mounted perpendicular to hydraulic cylinders 35, and has its piston shaft 43 connected to one end of brake band 39. The other end of brake band 39 is connected to frame 31. Retraction of hydraulic cylinder 41 increases the friction between band 39 and drum 27.

Figure 2:
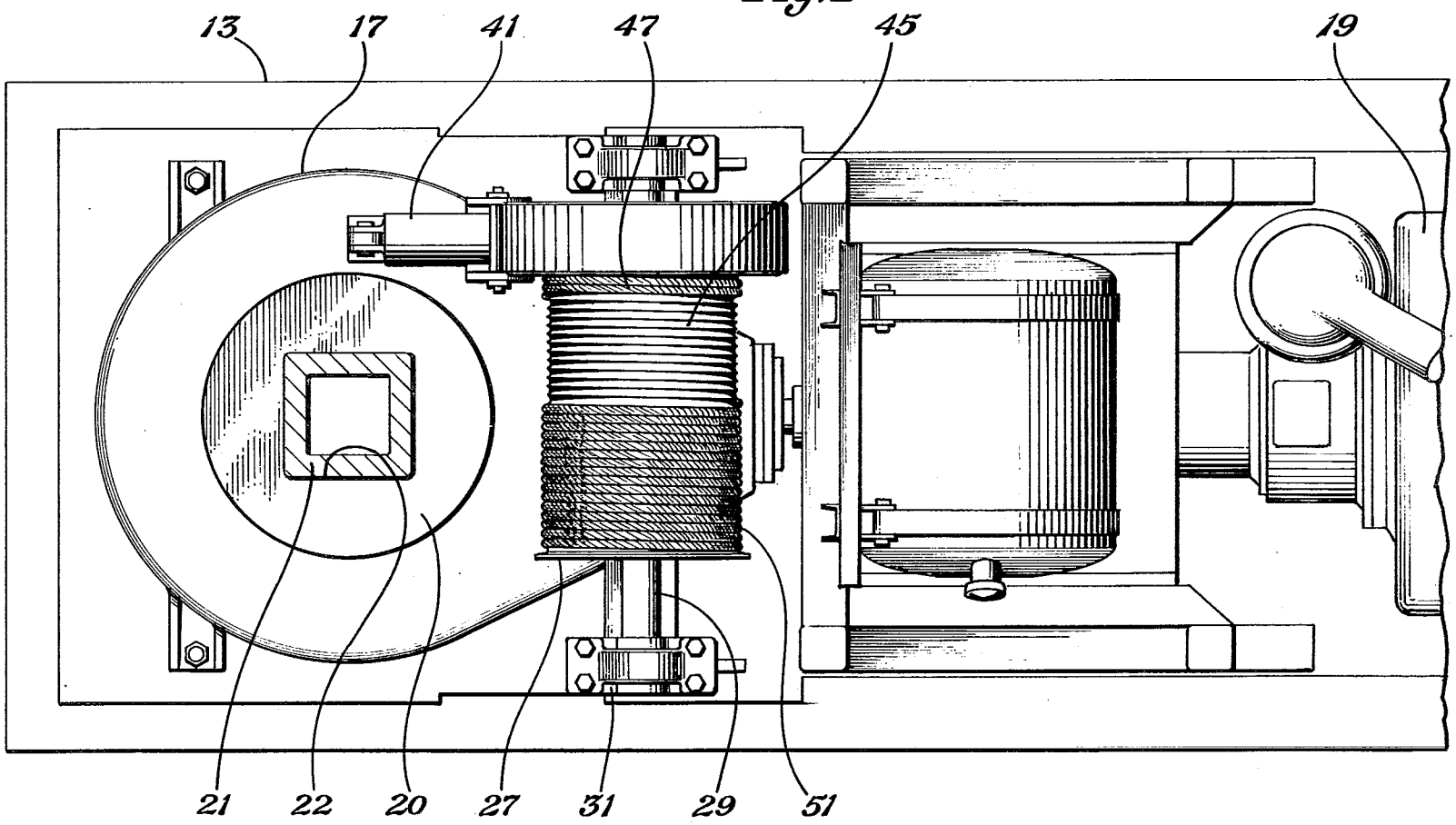
FIG. 2 is a cross-sectional view of the downcrowding device taken along the lines II—II of FIG. 1.

Referring also to FIG. 2, drum 27 has a plurality of circumferential grooves 45 for receiving cable. A downcrowding cable 47 is wrapped in a single layer around one side of drum 27. Downcrowding cable 47 extends directly to an arm 49 that forms a part of kelly head 23. Drum 27 is positioned close enough to kelly 21, so as to transmit substantially all of the downcrowding force in the downward direction.

A take-up cable 51 is wrapped in a single layer around the drum 27 on the other side from and opposite in direction to downcrowding cable 47. Drawing one cable will cause drum 27 to rotate and take up an equal amount from the other cable. Take-up cable 51 is reeved over a sheave 25 at the end of boom 15 and attached to kelly head 23 by a spring means 53. The lengths of cables 47, 51 and size of drum 27 are selected so that one cable will not overlap the other regardless of the position of kelly 21.

The spring means 53 allows the distance between the kelly head 23 and the end 55 of take-up cable 51 to change, and also urges end 55 toward kelly 23 to take up slack when brake 39 is released. Spring means 53 comprises a cylindrical tube 57 connected to kelly head 23. A rod 59 is fixed to cable end 55 and inserted into an aperture in the top of tube 57. The lower end of rod 59 has an annular flange or shoulder 61. The aperture in the top of tube 57 also has a shoulder (not shown). A coil spring 63 is compressed between the shoulder 61 and the shoulder at the top of tube 57 for urging rod 59 downward.

Figure 3:
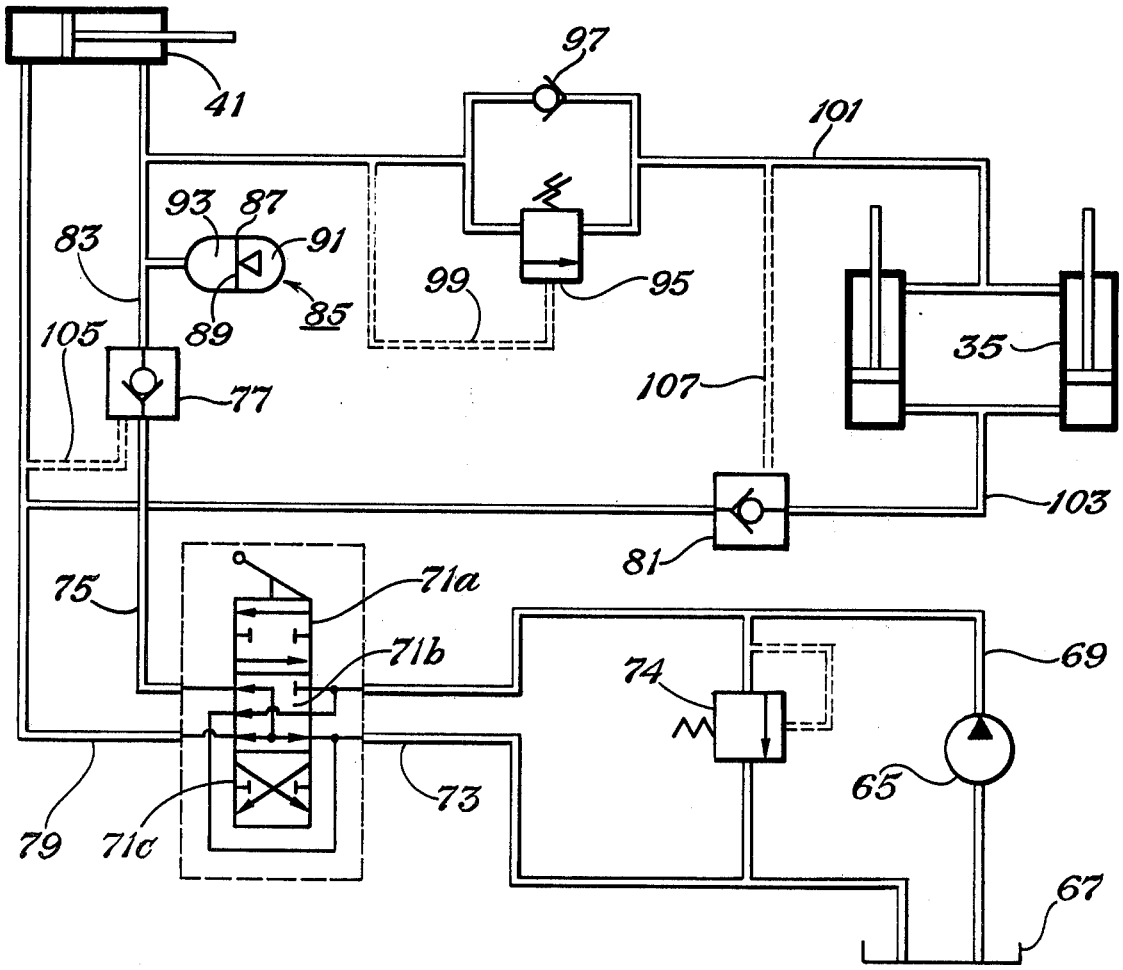
FIG. 3 is a schematic diagram of the hydraulic circuitry for the downcrowding device of FIGS. 1.

The hydraulic circuitry for the downcrowding system is shown in FIG. 3. A positive displacement pump 65 draws fluid from a reservoir 67. Pump 65 is connected by line 69 to a two position three-way control valve 71. A return line 73 leads from both sides of control valve 71 back to reservoir 67. A pressure relief valve 74, set to relieve at 2000 psi (pounds per square inch), is connected between lines 69 and 73. A line 75 leads from control valve 71 to a check valve 77. A second line 79 leads from control valve 71 to a second check valve 81 and also directly to brake cylinder 41. Position 71*a* of control valve 71 allows fluid to pass from pump 65 through line 75 to check valve 77, and to return from line 79 to lines 73 and thence to reservoir 67. Position 71*b* is a neutral position, allowing pumped fluid to flow through the valve at low pressure and back through return lines 73 to reservoir 67. Position 71*c* allows pumped fluid to flow from line 69 into line 79, returning from line 75 to line 73 and thence to reservoir 67.

A line 83 connects the normally downstream side of check valve 77 to hydraulic cylinder 41 on the opposite side of the piston from the line 79 connection. Fluid pressure in line 83 causes the brake 39 to lock, while fluid pressure in line 79 causes brake 39 to release.

An accumulator 85 is also connected to line 83. Accumulator 85 comprises a housing 87 divided by floating piston 89 into a gas chamber 91 and a fluid chamber 93. Gas chamber 91 contains a gas, preferably nitrogen, that is pressurized to a level of approximately 300 psi when there is no fluid in fluid chamber 93. Fluid pressure greater than this level will constrict the volume of gas chamber 91, causing the pressure to equalize. As the fluid pressure drops, piston 89 will move to increase the volume of gas chamber 91, providing a positive fluid pressure until the fluid from the fluid chamber is exhausted.

Fluid line 83 is also connected to a sequence valve 95 in parallel with a check valve 97. Sequence valve 95 has a pressure sensing input line 99, and is biased to require approximately 500 psi of pressure in line 83 before it will allow fluid to pass. Check valve 79 has its downstream side in connection with line 83 so as to prevent flow from line 83.

A fluid line 101 connects the parallel arrangement of sequence valve 95 and check valve 97 to the hydraulic cylinders 35 that move the drum linearly. Fluid line 101 is connected to the side of hydraulic cylinder 35 that causes them to lower the drum 27 when pressurized. A fluid line 103 is connected to the hydraulic cylinder 35 on the opposite side of the pistons, and extends to the normally downstream side of check valve 81.

Check valves 77 and 81 are of a type that will allow flow in a normally reverse direction if they sense a pressure from another source. Check valve 77 has a pressure sensing fluid line 105 connected with fluid line 79. If a minimum pressure of approximately 12 psi exists in line 79, the closure member in valve 77 will move from its seat, allowing fluid to flow from line 83 to line 75. Check valve 81 has a pressure sensing fluid line 107 that extends to line 101. If a minimum pressure of approximately 12 psi exists in line 101, then its closure member will move from its seat, allowing fluid to pass from line 103 to line 70. The purpose of check valve 77 is to prevent fluid passage through control valve 71 to the reservoir 67 while the valve is in the neutral position and the system is under pressure from accumulator 85. Check valve 81 prevents the hydraulic cylinders 35 from moving down under their own weight when control valve 71 is in the neutral position and when the downcrowding system is not in operation.

The operation may be best explained by referring to FIGS. 3–6. The downcrowding system is initially rigged up with downcrowding cable 47 and take-up cable 51 taut. Spring means 53 will be under some tension. The position of the boom 15 with respect to the platform 13 will remain constant during drilling. Kelly 21 should be hoisted by the crane winch to an initial position with kelly head 23 a considerable distance above the kelly bushing 20. Drum 27 should be in the upper position, with the hydraulic cylinders 35 extended the maximum distance.

As the rotary table 17 rotates the kelly 21, it begins advancing into the earth. To assist the advancement, the downcrowding circuit may be used. As shown in FIG. 3, this is performed by placing control valve 71 into downcrowding position 71*a*. Fluid will be supplied through lines 75 and 83, and returned from hydraulic cylinder 41 by lines 79 and 73, locking brake 39.

Once the pump pressure reaches 300 psi. the accumulator 85 will begin filling and its piston 89 will move to the right. Once the pressure reaches 500 psi, sequence valve 95 will allow fluid to pass through line 101 to the drum hydraulic cylinders 35. Pressure in line 101 will be sensed by check valve 81, allowing fluid to return from the hydraulic cylinders 35 to the reservoir 67 via lines 103, 79 and 73.

The operator manually holds control valve 71 in downcrowding position 71*a*, until sufficient downcrowding force is achieved, which can be observed on a pressure gage as well as determined by listening to the sound of the drilling. If not released sooner, pressure will relieve at 2000 psi through pressure relief valve 74. The downcrowding force at 2000 psi was 25,900 pounds for one downcrowding device tested. Once the control valve 71 is physically released, it shifts to the neutral position 71*b*, wherein the pumped fluid will cycle through the control valve 71 back to reservoir 67. High pressure will still be maintained in lines 83 and 101 by means of the accumulator 85, which serves as sustaining means for maintaining hydraulic pressure on the hydraulic rams as they move the drum downwardly. Since a positive pressure exists in line 101, return flow through lines 103 and 73 continues. When the hydraulic rams have moved four or five inches, the pressure will have dropped low enough such that the operator may again wish to pressurize. He simply places the control valve 71 back into downcrowding position 71*a* for a few seconds, recharging the accumulator 85.

Figure 5:
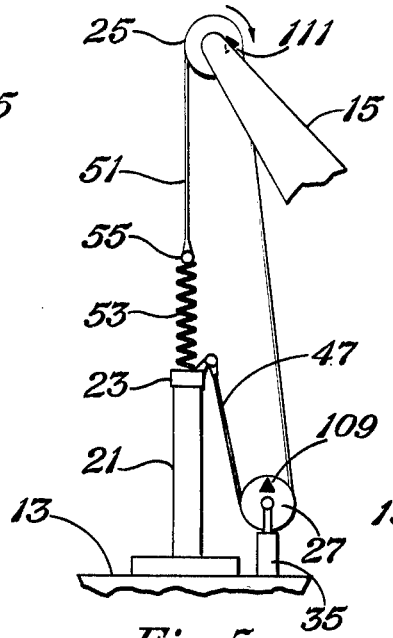
FIG. 5 is a schematic side elevational view of the downcrowding device of FIG. 1 with the drum in the lower position.

The kelly 21 and hydraulic cylinders 35 will travel downward until they reach the end of the stroke, as shown in FIGS. 1 and 5, which may be approximately one foot. As shown by the indicating symbol 109, drum 27 will not have rotated. Take-up cable end 55 will have moved upward, stretching spring means 53. Boom sheave 25 will have rotated because of the downward movement of drum 27, as indicated by indicating symbol 111.

Figure 4:
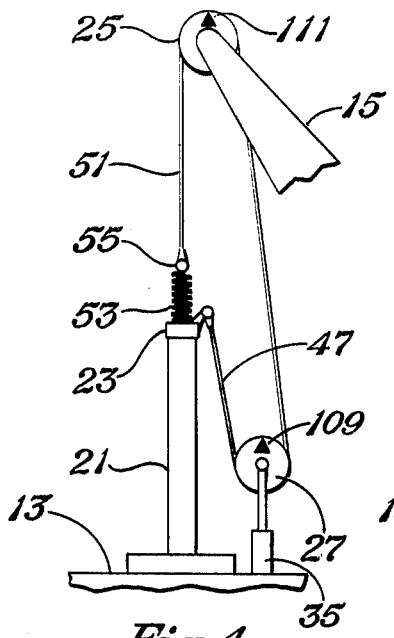
FIG. 4 is a schematic side elevational view of the downcrowding device of FIG. 1 with the drum in the upper position.
Figure 6:
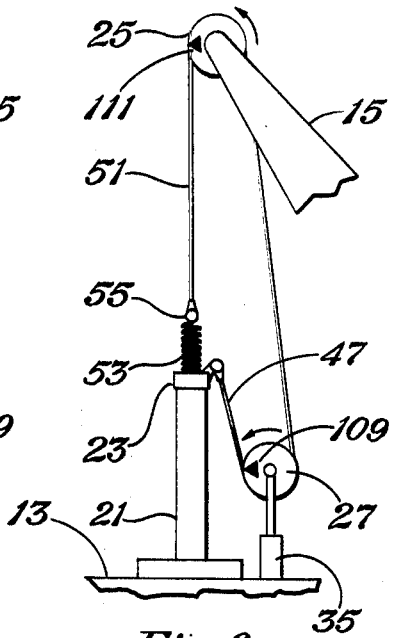
FIG. 6 is a schematic side elevational view of the downcrowding device of FIG. 1 with the drum shifted back to the upper position.

In order to continue downcrowding, the operator must return the drum to the upper position as shown in FIG. 4. Drilling rotation while moving the drum may continue if desired. Control valve 71 is placed into return position 71*c*, relieving pressure in lines 75, 83 and 101. Pump pressure is applied to lines 79 and 103, releasing brake 39 and moving hydraulic cylinders 35 upward. Return for the brake hydraulic cylinder 41 passes through lines 83, 75 and 73. Check valve 77 will be opened for reverse flow because of the pressure in line 79. Return flow for the hydraulic cylinders 35 will be through line 101, check valve 97, line 83, check valve 77, and lines 75 and 73. During upward movement, spring means 53 will be allowed to return to its initial state. As shown in FIG. 6, drum 27 and sheave 25 will be rotated by the spring force, taking up slack in downcrowding cable 47. The cycle may then be repeated until the kelly head 23 nears the same level as drum 27.

Preferably a crowd reaction device of known design is coupled between platform 13 and boom 15 so as to transmit reacting forces from the platform to the crane.

It should be apparent that an invention having significant advantages has been provided. The downcrowding device is capable of applying a large amount of force without transmitting the force through the mast. Slack is removed without requiring a power driven winch. The force applied is a positive force, not dependent on the friction between the kelly bushing and the kelly.

While the invention has been shown in only one of its forms, it should be apparent to those skilled in the art that it is not so limited but it is susceptible to various changes and modifications without departing from the spirit thereof.

I claim:

1. In an earth boring apparatus having a mast, a drive member carried by the mast for linear movement and means for rotating the drive member, the drive member adapted to receive and rotate earth cutting tools for penetrating the earth, an improved downcrowding means for exerting a downward force on the drive member, comprising:

a rotatable drum;

hydraulic ram means connected to the drum for moving the drum downwardly;

brake means connected with the drum for selectively preventing rotation of the drum; and a cable connected to the drive member and wrapped around the drum for exerting a downward force on the drive member by the hydraulic ram means when the brake is actuated.

2. In an earth boring apparatus of the type having rotary drive means carried by a platform and a kelly extending reciprocally through the rotary drive means for rotation therewith, an improved downcrowding means for exerting a downward force on the kelly comprising:

a rotatable drum;

hydraulic ram means connected between the drum and the platform for moving the drum downwardly with respect to the platform;

brake means connected with the drum for selectively preventing rotation of the drum; and a cable wrapped around the drum and extending directly to the top of the kelly for transmitting the downwardly acting force of the hydraulic ram means to the kelly.

3. In an earth boring apparatus of the type having rotary drive means carried by a platform and a kelly extending reciprocally through the rotary drive means for rotation therewith, an improved downcrowding means for exerting a downward force on the kelly comprising:

a rotatable drum;

hydraulic ram means connected between the drum and the platform for moving the drum downwardly with respect to the platform;

brake means connected with the drum for selectively preventing rotation of the drum;

a cable wrapped around the drum and extending directly to the top of the kelly for transmitting the downwardly acting force of the hydraulic ram means to the kelly; and take-up means for automatically removing slack in the downcrowding cable as the hydraulic ram means raises the drum for commencing a new stroke.

4. In an earth boring apparatus of the type having rotary drive means carried by a platform and a kelly suspended by a mast and extending reciprocally through the rotary drive means for rotation by it, an improved downcrowding means for exerting a downward force on the kelly, compising:

a rotatable drum;

hydraulic ram means connected between the drum and the platform for moving the drum linearly in a direction substantially parallel with the length of the kelly;

brake means connected with the drum for selectively preventing rotation of the drum;

a downcrowding cable wrapped around the drum and connected directly to the top of the kelly to transmit downward force exerted by the hydraulic ram means to the kelly when the brake means is actuated;

a take-up cable wrapped around the drum in the direction opposite to the downcrowding cable and reeved to the mast; and spring means connected between the top of the kelly and the end of the take-up cable for allowing the distance between the top of the kelly and the end of the take-up cable to change, and for urging the end of the take-up cable toward the top of the kelly to take up slack when the brake is released and the drum moved upward; the drum being rotated only by the movement of the downcrowding and take-up cables.

5. The earth boring apparatus according to claim 4 wherein the spring means comprises:

a tube connected to the top of the kelly;

a rod attached to the end of the take-up cable and reciprocally carried in the tube, the rod having a shoulder on its lower end; and a coil spring encircling the rod and compressed between the shoulder and the top of the tube.

6. The earth boring apparatus according to claim 4 wherein the drum comprises a single drum with the downcrowding cable wrapped on one side and the take-up cable wrapped on the other side, the drum being dimensioned such that not more than one layer of cable need wrap on the drum regardless of the position of the kelly with respect to the mast.

7. In a crane mounted earth boring apparatus having rotary drive means carried by a platform attached to the crane, a kelly suspended from a boom and extending reciprocally through the rotary drive means for rotation therewith, an improved downcrowding means for exerting a downward force on the kelly, comprising:

a rotatable drum;

a hydraulic cylinder connected between the drum and the platform parallel with the kelly for moving the drum linearly parallel to the kelly;

hydraulic circuit means connected to the hydraulic cylinder for reciprocating it;

brake means connected with the drum for selectively preventing rotation of the drum;

a downcrowding cable wrapped around the drum and connected directly to the top of the kelly for transmitting downwardly acting force from the hydraulic cylinder to the kelly when the brake is actuated;

a take-up cable wrapped around the drum in the direction opposite to the downcrowding cable, the take-up cable being reeved to the boom;

spring means connected between the top of the kelly and the end of the take-up cable for allowing the distance between the top of the kelly and the end of the take-up cable to change when the kelly and drum move downward with the brake actuated, and for urging the end of the take-up cable toward the top of the kelly when the drum is moved upward and allowed to rotate; and sustaining means for maintaining hydraulic pressure on the hydraulic cylinder as it moves the drum downwardly.

8. In a crane mounted earth boring apparatus having rotary drive means carried by a platform attached to the crane, a kelly suspended from a boom and extending reciprocally through the rotary drive means for rotation therewith, an improved downcrowding means for exerting downward force on the kelly, comprising:

a rotatable drum;

a hydraulic cylinder connected between the drum and the platform parallel with the kelly for moving the drum linearly parallel to the kelly;

hydraulic circuit means including a pump, reservoir and lines connected to the hydraulic cylinder for reciprocating it;

brake means connected with the drum for selectively preventing rotation of the drum;

a downcrowding cable wrapped around the drum and connected directly to the top of the kelly for transmitting downwardly acting force to the kelly when the brake is actuated;

a take-up cable wrapped around the drum in the direction opposite to the downcrowding cable, the take-up cable being reeved to the boom;

spring means connected between the top of the kelly and the end of the take-up cable for allowing the distance between the top of the kelly and the end of the take-up cable to change when the kelly and drum move downward with the brake actuated, and for urging the end of the take-up cable toward the top of the kelly when the drum is moved upward and allowed to rotate; and an accumulator, connected into the line that supplies fluid to move the hydraulic cylinder downwardly, having a fluid chamber for receiving pressurized hydraulic fluid and a biased piston on one side of the fluid chamber for urging the fluid from the fluid chamber, thereby maintaining pressure at the hydraulic cylinder even though pumping pressure has been removed.

9. The earth boring apparatus according to claim 8 wherein the piston is biased by a gas chamber separated from the fluid chamber by the piston and filled with gas to a selected pressure.

* * * * *